US010141632B2

(12) United States Patent
Galeev

(10) Patent No.: US 10,141,632 B2
(45) Date of Patent: Nov. 27, 2018

(54) WIRELESS ELECTRONIC DEVICES WITH METAL PERIMETER PORTIONS INCLUDING A PLURALITY OF ANTENNAS

(71) Applicant: Sony Corporation, Tokyo (JP)

(72) Inventor: Roustem Galeev, Lund (SE)

(73) Assignee: SONY MOBILE COMMUNICATIONS INC., Tokyo (JP)

( * ) Notice: Subject to any disclaimer, the term of this patent is extended or adjusted under 35 U.S.C. 154(b) by 0 days.

(21) Appl. No.: 14/355,703

(22) PCT Filed: Jun. 27, 2013

(86) PCT No.: PCT/JP2013/068306
§ 371 (c)(1),
(2) Date: May 1, 2014

(87) PCT Pub. No.: WO2014/207945
PCT Pub. Date: Dec. 31, 2014

(65) Prior Publication Data
US 2015/0244061 A1 Aug. 27, 2015

(51) Int. Cl.
*H01Q 1/24* (2006.01)
*H01Q 1/50* (2006.01)

(52) U.S. Cl.
CPC ..... *H01Q 1/243* (2013.01); *H01Q 1/50* (2013.01)

(58) Field of Classification Search
CPC ..... H01Q 1/243; H01Q 1/50
USPC ..... 343/702
See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,764,236 | B2 * | 7/2010 | Hill | H01Q 1/243 343/702 |
| 8,432,320 | B2 * | 4/2013 | Jagielski | H01Q 1/243 343/700 MS |
| 8,750,949 | B2 * | 6/2014 | Merz | H04B 1/38 343/702 |
| 8,907,853 | B2 * | 12/2014 | Ying | H01Q 1/243 343/702 |
| 2004/0257283 | A1 | 12/2004 | Asano et al. | |
| 2012/0112969 | A1 | 5/2012 | Caballero et al. | |
| 2012/0175165 | A1 | 6/2012 | Merz et al. | |
| 2013/0076580 | A1 | 3/2013 | Zhang et al. | |
| 2013/0194138 | A1 * | 8/2013 | Hammond | H01Q 1/243 343/702 |

FOREIGN PATENT DOCUMENTS

| | | | |
|---|---|---|---|
| EP | 2 528 165 | A1 | 11/2012 |
| WO | WO 2011/106899 | A1 | 9/2011 |

OTHER PUBLICATIONS

International Search Report and Written Opinion Corresponding to PCT International Application No. PCT/JP2013/068306; dated Feb. 26, 2014; 10 Pages.

* cited by examiner

*Primary Examiner* — Dameon E Levi
*Assistant Examiner* — Hasan Islam
(74) *Attorney, Agent, or Firm* — Myers Bigel, P.A.

(57) ABSTRACT

Wireless electronic devices may include a ground plane and metal antenna portions separated by input connector portions improving the metal look and feel of the wireless electronic device.

22 Claims, 12 Drawing Sheets

500

600

Cellular bands

700

800

900

1000

1300

1400

WiFi/Bluetooth MIMO antennas

1500

1600

WIRELESS ELECTRONIC DEVICES WITH METAL PERIMETER PORTIONS INCLUDING A PLURALITY OF ANTENNAS

CROSS-REFERENCE TO RELATED APPLICATION

This application is a 35 U.S.C. § 371 national stage application of PCT International Application No. PCT/JP2013/068306, filed on Jun. 27, 2013, the disclosure and contents of which are incorporated by reference herein as if set forth in its entirety.

TECHNICAL FIELD

The present inventive concepts generally relate to the field of communications and, more particularly, to antennas and wireless electronic devices incorporating the same.

BACKGROUND

Wireless electronic devices may include insulators between nearby antennas to reduce antenna interference. Such insulators may be exposed to users of the wireless electronic devices in a way that provides a discontinuous look and/or feel to the exterior of the wireless electronic devices.

SUMMARY

Various embodiments of the present inventive concepts include wireless electronic devices. According to some embodiments, a wireless electronic device may include a ground plane, a first metal perimeter portion, such as an antenna portion, extending along a perimeter around and spaced apart from the ground plane, a second metal perimeter portion, such as an antenna portion, extending along the perimeter opposite the first metal antenna portion, a first input connector portion on the perimeter galvanically insulating a first end of the first metal antenna portion from a first end of the second metal antenna portion and a second input connector portion on the perimeter galvanically insulating a second end of the first metal antenna portion and a second end of the second metal antenna portion. The first and second metal antenna portions and the first and second input connection portions may collectively define a continuous outer surface of the wireless electronic device along a full length of the perimeter.

According to some embodiments, the first and second input connector portions comprise outer surfaces that are substantially coplanar with outer surfaces of the first and second ends of the first and second metal antenna portions.

According to other embodiments, the first metal antenna portion comprises first and second antennas and the second metal antenna portion comprises third and fourth antennas. According to further embodiments, the first and second antennas are physically connected to each other by the first metal antenna portion on the perimeter and the third and fourth antennas are physically connected to each other by the second metal antenna portion on the perimeter.

According to some embodiments, the first and fourth antennas comprise first and second cellular antennas, respectively. The first and second cellular antennas may comprise first and second half-loop antennas, respectively. In further embodiments, the wireless electronic device may also include a multi-band transceiver circuit coupled to at least one of the first and second cellular antennas and configured to provide communications for the wireless electronic device via a plurality of frequency bands.

According to some embodiments, the second antenna comprises a positioning antenna. According to further embodiments, the wireless electronic device may include a first ground connection between the first metal antenna portion and the ground plane at an end of the first cellular antenna, separately defining the first cellular antenna from the positioning antenna.

According to some embodiments, the third antenna comprises a non-cellular antenna. The third antenna may comprise first and second WiFi antennas. According to further embodiments, the wireless electronic device may include a second ground connection between the second metal antenna portion and the ground plane at an end of the second cellular antenna, separately defining the second cellular antenna from the non-cellular antenna.

According to some embodiments, the first and second input connector portions are respectively located in respective middle of each opposing smaller side edge of the perimeter. The first and second input connector portions may comprise an audio jack and a power/data input component.

According to some embodiments, a wireless electronic device may include a ground plane, first and second symmetrical metal antenna portions forming a metal perimeter around the ground plane and first and second discontinuities in the metal perimeter separating the first and second symmetrical metal antenna portions.

According to further embodiments, the first and second antennas share the first symmetrical metal antenna portion and third and fourth antennas share the second symmetrical metal antenna portion.

According to some embodiments, at least two of the first, second, third and fourth antennas are coupled to a multi-band transceiver circuit and configured to provide communications for the wireless electronic device via a plurality of frequency bands using LTE-Advanced carrier aggregation.

According to some embodiments, a wireless electronic device may include a ground plane, a metal perimeter around the ground plane, and first and second discontinuities in the metal perimeter at two opposing edges of the wireless electronic device.

According to further embodiments, the metal perimeter may include first and second cellular antennas, a global positioning antenna and first and second non-cellular antennas. The first and second discontinuities may comprise input components.

Other devices and/or systems according to embodiments of the inventive concepts will be or become apparent to one with skill in the art upon review of the following drawings and detailed description. It is intended that all such additional devices and/or systems be included within this description, be within the scope of the present inventive concepts, and be protected by the accompanying claims. Moreover, it is intended that all embodiments disclosed herein can be implemented separately or combined in any way and/or combination.

DETAILED DESCRIPTION

Figure 1:
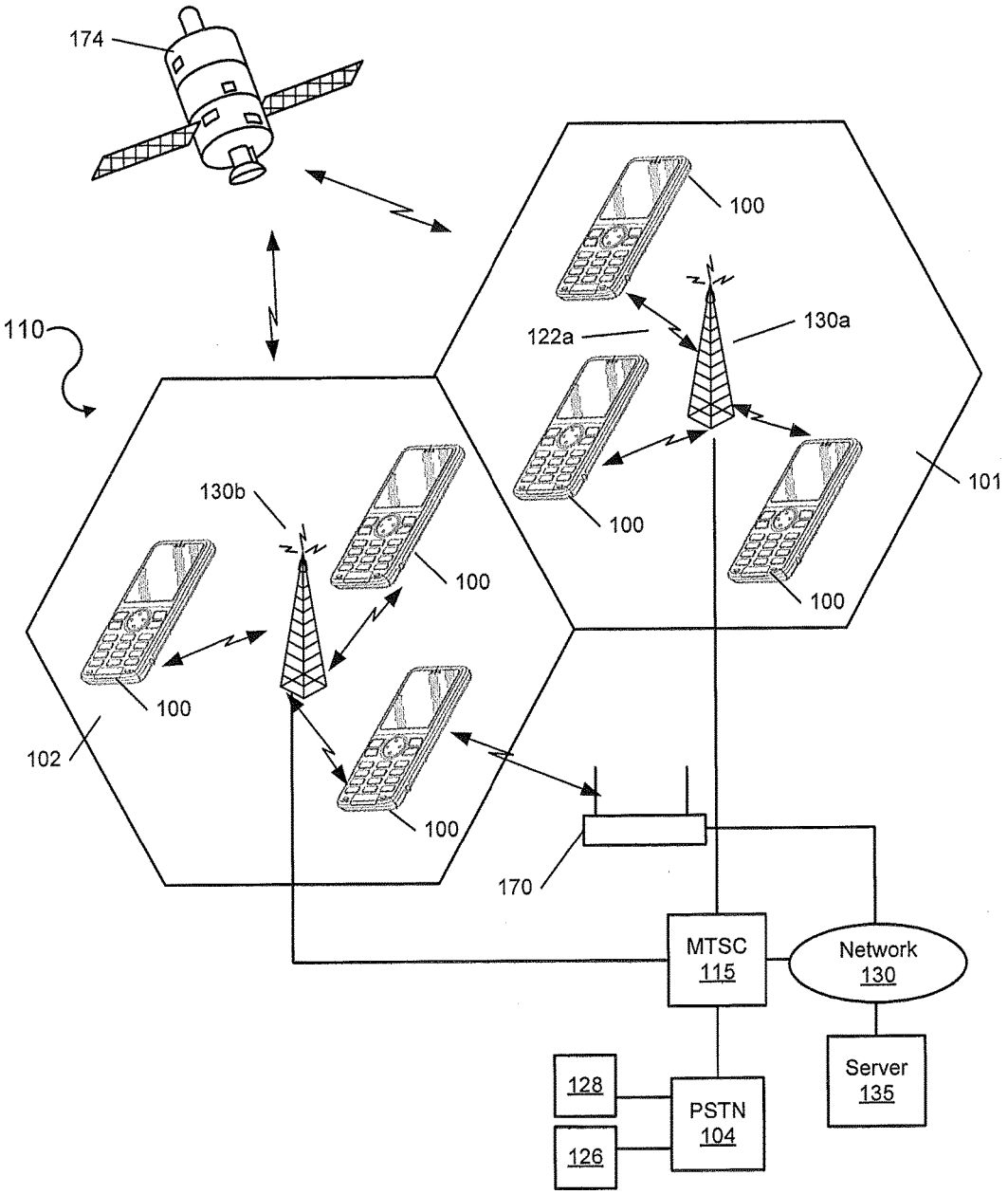
FIG. 1 is a schematic illustration of a wireless communications network that provides service to wireless electronic devices, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above," "below," "upper," "lower," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concepts are described herein in the context of "wireless electronic devices." Among other devices/systems, wireless electronic devices may include multi-band wireless communication terminals (e.g., portable electronic devices/wireless terminals/mobile terminals/terminals) that are configured to carry out cellular communications (e.g., cellular voice and/or data communications) in more than one frequency band. It will be understood, however, that the present inventive concepts are not limited to such embodiments and may be embodied generally in any device and/or system that is configured to transmit and receive in one or more frequency bands. Moreover, the terms "about" and "substantially," as described herein, mean that the recited number or value can vary by +/−25%.

An LTE-Advanced mobile device's capability may benefit from two high performance cellular antennas. For example, good transceiver performance of two cellular antennas may be necessary for dual transceiver multiple-in-multiple-out (MIMO) schemes and for carrier aggregation in the different operating bands. Current design trends may place a high value on the use of metal on the surfaces of mobile devices, but this may restrict available antenna positions. Mobile devices may include a front metal frame around an active area of a display screen, and the front metal frame may be a part of (e.g., may not be separated from) a chassis/ground plane of the mobile devices and may thus provide a relatively weak configuration for an antenna system. In addition, exposed insulators along an exterior of a conventional wireless electronic device may provide a discontinuous look and/or feel.

Various embodiments described herein, however, may provide a multiband cellular, positioning and local connectivity antenna system. Two metal perimeter portions may form a perimeter around a mobile device, with two discontinuities between them on the perimeter for input connectors. For example, the input connectors may be for a power/data/USB connector in the middle position on the bottom of a mobile phone and an audio connector jack in the middle position on the top of the phone, achieving a "streamlined IN/OUT" effect along the longer axis of the phone.

The two metal perimeter portions may combine with an internal configuration to form a multiband multiple antenna structure. Adjacent antennas on each metal perimeter portion, or antenna portion, on the perimeter may physically contact each other to provide a continuous metal outer surface. Accordingly, various embodiments described herein may provide a smoother, more continuous look and/or feel to the exterior of a wireless electronic device, and/or may use a front metal frame as a multi-band antenna system with good performance characteristics.

According to various embodiments, the two metal perimeter portions may be antenna portions. Although the perimeter portions may be described as antenna portions in embodiments herein and may be used substantially as radiating elements, the full length of the antenna portion may not necessarily, in some cases, act as a radiating element and may extend to complete a perimeter for cosmetic purposes. In some cases, an end of an antenna portion may extend beyond a ground connection to the ground plane or an effective end of an antenna. In other cases, a short segment of an antenna portion may exist between two antenna configurations that share the metal perimeter antenna portion.

Referring to FIG. 1, a diagram is provided of a wireless communications network 110 that supports communications in which wireless electronic devices 100 can be used according to various embodiments of the present inventive concepts. The network 110 includes cells 101, 102 and base stations 130*a*, 130*b* in the respective cells 101, 102. Networks 110 are commonly employed to provide voice and data communications to subscribers using various radio access standards/technologies. The network 110 may include wireless electronic devices 100 that may communicate with the base stations 130*a*, 130*b*. The wireless electronic devices 100 in the network 110 may also communicate with a Global Positioning System (GPS) satellite 174, a local wireless network 170, a Mobile Telephone Switching Center (MTSC) 115, and/or a Public Service Telephone Network (PSTN) 104 (i.e., a "landline" network).

The wireless electronic devices 100 can communicate with each other via the Mobile Telephone Switching Center (MTSC) 115. The wireless electronic devices 100 can also communicate with other devices/terminals, such as terminals 126, 128, via the PSTN 104 that is coupled to the network 110. As also shown in FIG. 1, the MTSC 115 is coupled to a computer server 135 via a network 130, such as the Internet.

The network 110 is organized as cells 101, 102 that collectively can provide service to a broader geographic region. In particular, each of the cells 101, 102 can provide service to associated sub-regions (e.g., regions within the hexagonal areas illustrated by the cells 101, 102 in FIG. 1) included in the broader geographic region covered by the network 110. More or fewer cells can be included in the network 110, and the coverage area for the cells 101, 102 may overlap. The shape of the coverage area for each of the cells 101, 102 may be different from one cell to another and is not limited to the hexagonal shapes illustrated in FIG. 1. Each of the cells 101, 102 may include an associated base station 130*a*, 130*b*. The base stations 130*a*, 130*b* can provide wireless communications between each other and the wireless electronic devices 100 in the associated geographic region covered by the network 110.

Each of the base stations 130*a*, 130*b* can transmit/receive data to/from the wireless electronic devices 100 over an associated control channel. For example, the base station 130*a* in cell 101 can communicate with one of the wireless electronic devices 100 in cell 101 over the control channel 122*a*. The control channel 122*a* can be used, for example, to page the wireless electronic device 100 in response to calls directed thereto or to transmit traffic channel assignments to the wireless electronic device 100 over which a call associated therewith is to be conducted.

The wireless electronic devices 100 may also be capable of receiving messages from the network 110 over the respective control channels 122*a*. In various embodiments, the wireless electronic devices 100 receive Short Message Service (SMS), Enhanced Message Service (EMS), Multimedia Message Service (MMS), and/or Smartmessaging™ formatted messages.

The GPS satellite 174 can provide GPS information to the geographic region including cells 101, 102 so that the wireless electronic devices 100 may determine location information. The network 110 may also provide network location information as the basis for the location information applied by the wireless electronic devices 100. In addition, the location information may be provided directly to the server 135 rather than to the wireless electronic devices 100 and then to the server 135. Additionally or alternatively, the wireless electronic devices 100 may communicate with the local wireless network 170.

Figure 2A:
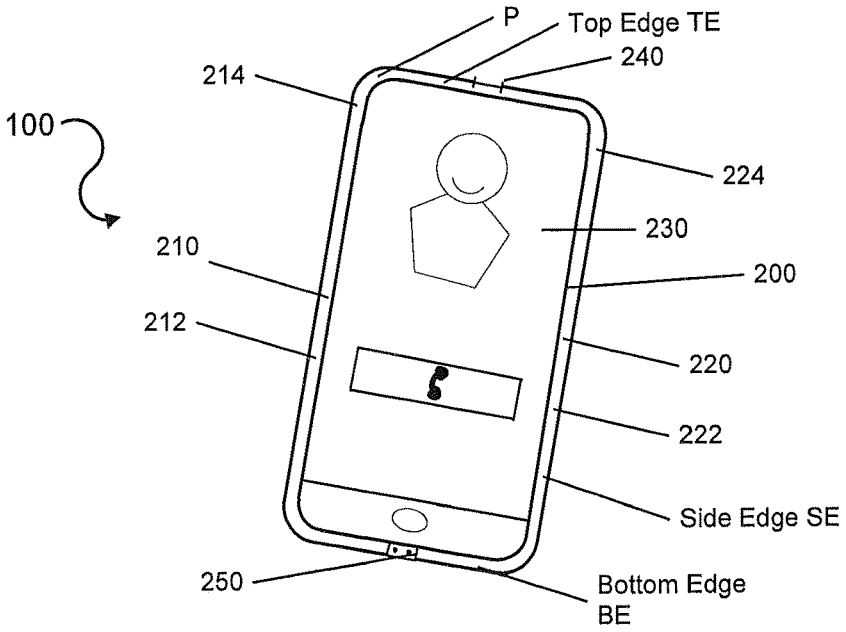
FIGS. 2A and 2B illustrate front and rear views, respectively, of a wireless electronic device, according to various embodiments.
Figure 2B:
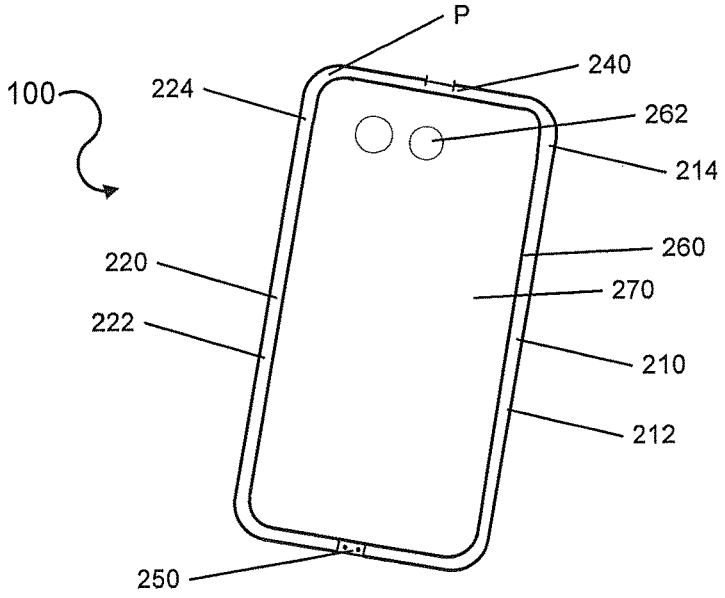

FIGS. 2A and 2B illustrate front and rear views, respectively, of a wireless electronic device 100, according to various embodiments of the present inventive concepts. Accordingly, FIGS. 2A and 2B illustrate opposite sides of the wireless electronic device 100. In particular, FIG. 2A illustrates a front face 200 of the wireless electronic device 100, which may include a display 230 (e.g., touchscreen). Accordingly, the front face 200 may be visible to, and/or in contact with, a user of the wireless electronic device 100. FIG. 2A also shows two metal perimeter portions, or antenna portions, which may be u-shaped metal bands 210 and 220 along a perimeter P of the wireless electronic device 100. The metal antenna portions are described as substantially u-shaped metal bands in some embodiments for purposes of explanation and are not meant to be limited to U shapes and/or bands. For example, the metal antenna portions may be other orthogonal or non-planar shapes.

According to various embodiments, the metal bands 210 and 220 may be planar in shape. In some embodiments metal bands 210 and 220 may be flat on an outer surface of the perimeter facing away from the ground plane. In other embodiments, metal bands 210 and 220 may be curved or slightly rounded on the outer surface. Metal bands 210 and 220, may include flat, curved, serrated or beveled edges.

The metal bands 210 and 220 may be free of holes. In some cases, there may be openings in the metal bands 210 and 220 for audio output from a speaker, audio input to microphones, buttons or other purposes. However, the outer planar surface of the metal bands may be a continuous metal surface. The openings may not interrupt the continuity of at least some portion of the metal band at any point along the metal band. For example, some openings may be holes, but the metal band may be continuous along front and back edges of the metal bands 210 and 220 at the holes.

According to various embodiments, the metal bands 210 and 220 may be made of only metal. The metal may consist of a single metal or multiple metals in a metal alloy. The metal bands may be naturally metallic in color, or may be colored. In some cases, some non-metal materials may be embedded in or placed on portions of the metal bands. However, the metal bands will not be discontinuous at any point on the perimeter of the metal bands 210 and 220 due to the embedded or places non-metal elements. The antenna functionality of the metal bands may be maintained. Metal elements may also be placed on the metal bands 210 and 220 as long as they are integrated in the antennas electrical design.

According to some embodiments, the edges of the metal band may be coplanar with the front and/or back surfaces of the device 100. In other embodiments, the surfaces may be raised or lowered with respect to the first and/or back surfaces of the device 100. In yet other embodiments, the edges of the metal bands 210 and 220 may be covered by the external front face 200 and/or external back face 260. In some embodiments, external back face 260 or backplate 270 of the wireless electronic device 100 may overlap/cover at least a portion of metal bands 210 and 220. For example, if the metal bands 210 and 220 forms the outer surface of edges TE, SE and BE, then at least a portion of the metal bands 210, 220 may be recessed within a perimeter P of the external back face 260, and may be between the external back face 260 and a front external face 200 (e.g., a display 230) of the wireless electronic device 100. Accordingly, although portions of the metal bands 210, 220 may be outside the perimeter P of the external face 260 (e.g., as illustrated in the rear view of the wireless electronic device 100 provided in FIG. 2B), the metal bands 210, 220 may alternatively not be visible at all in the rear view of FIG. 2B or may be partially concealed by the external face 260 and/or backplate 270.

The metal bands 210 and 220 are separated by insulating discontinuities, such as first and second user input components 240 and 250. The discontinuities completely sever the electric/galvanic/metal continuity of a metal band. For example, a discontinuity disconnects the outer surface, corners and front and back edges of any cross-sectional portion of a metal band. Input components 240 and 250 may be planar and may separate (e.g., physically between and electrically isolate) the first and second metal bands 210, 220.

In some embodiments, the entire outer (e.g., external) surface of the planar user input components 240 and 250 may be planar (e.g., flat/smooth) and may be coplanar with the outer surfaces of adjacent portions of the metal bands 210 and 220 around the perimeter P of the wireless electronic device 100. For example, the outer surface of the planar user input component 240 may receive a headphones input in a hole of the component 240 and all the rest of the exposed outer surface may be coplanar with an outer surface of an adjacent portion of the first metal band 210 and/or an outer surface of an adjacent portion of the second metal band 220.

In some embodiments, the user input components 240 and 250 may be located on opposite smaller ends of the wireless electronic device 100, as shown in FIGS. 2A and 2B. For example, the user input component 240 may be located on a top edge of the wireless electronic device 100 and the user input component 250 may be located on a bottom edge the device 100. The user input components 240 and 250 may be located in a central location of the respective edges of the wireless electronic device 100. The user input components 240 and 250 may serve to galvanically or electrically insulate the first metal band 210 from the second metal band 220. Except for the discontinuities of input component sections 240 and 250, the metal bands 210 and 220 would form a continuous metal band completely around the full length of the perimeter P.

According to some embodiments, the two metal perimeter bands 210 and 220 may be symmetrical in length, appearance, and/or placement on the perimeter P of the wireless electronic device 100. Each of metal bands 210 and 220 may cover all of a side edge SE and almost half of the top and bottom edges TE and BE. In other embodiments, the two metal bands 210 and 220 may also be slightly asymmetrical. For example, an audio jack may be placed, perhaps slightly, to the left or right on the top edge TE while the power/data outlet may be placed slightly left or right (on the same or opposite side of the edges) on a bottom edge BE of the device 100.

FIG. 2B illustrates an external back face 260 of the wireless electronic device 100. Accordingly, the external face 260 may be visible to, and/or in contact with, a user of the wireless electronic device 100. External face 260 may include features or openings 262, such as for a camera lens. In contrast, an internal face of external faces 200 and/or 260 may face internal portions of the wireless electronic device 100, such as a transceiver circuit. In some embodiments, the external back face 260 may include a metal backplate 270.

According to various embodiments, metal bands 210 and 220 may include various types of antennas configured for wireless communications. Metal band 210 may include first antenna 212 and second antenna 214. Metal band 220 may include third antenna 224 and fourth antenna 222.

According to some embodiments, at least one of the antennas 212, 222 may be a multi-band antenna and/or may be configured to communicate multiple cellular frequencies. Antennas 212 and 222 may be monopole antennas combined with parasitic elements or inverted-F antennas (IFA), among others. The antennas 212 and 222 may be half-loop antennas. The antennas 212 and 222 may be configured for LTE-Advanced communication. In some cases, antennas 212 and 222 may include antennas that utilize carrier aggregation. According to some embodiments, the first and second antennas 212, 222 may provide substantial portions of the metal side edges SE of the perimeter P of the wireless electronic device 100.

According to some embodiments, antenna 214 may be a non-cellular antenna. Antenna 214 may be a positioning antenna used for location purposes such as GPS positioning. In further embodiments, antenna 224 may also be used for non-cellular communication. Antenna 224 may comprise multiple antennas for short-range wireless applications such as WiFi and/or Bluetooth® communications.

Figure 3:
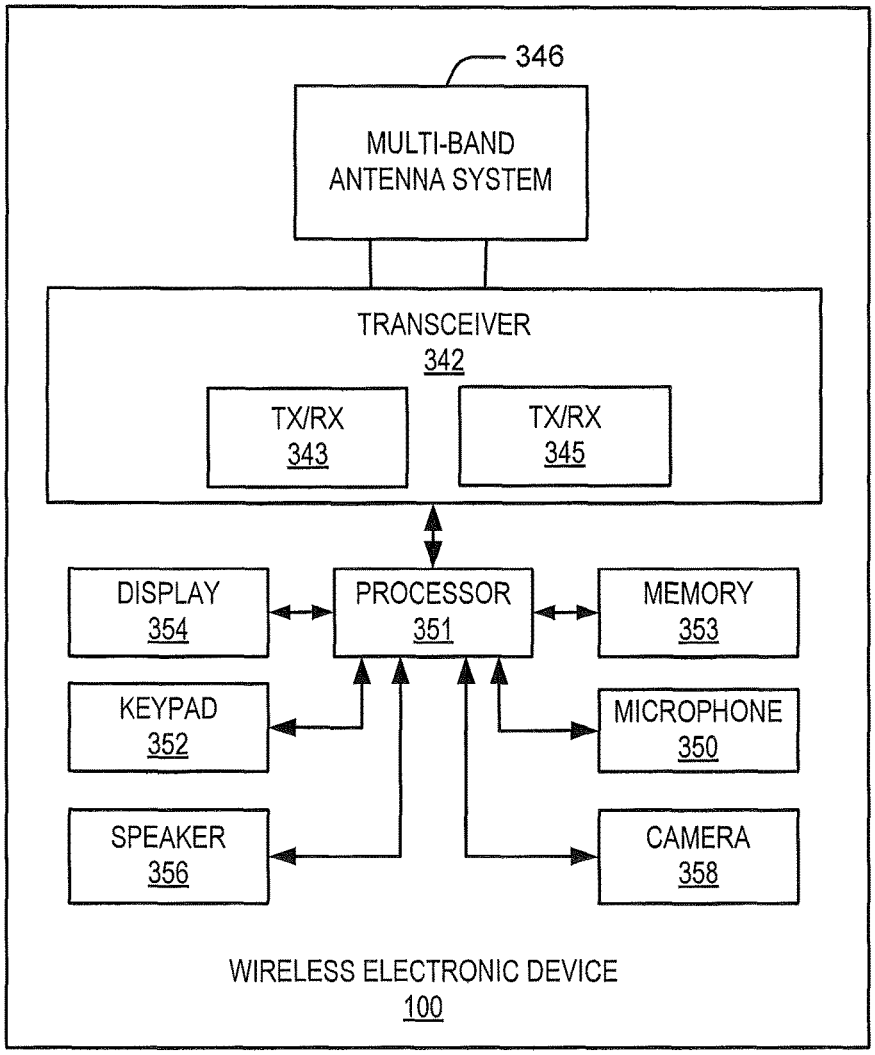
FIG. 3 is a block diagram illustrating a wireless electronic device, according to various embodiments.

FIG. 3 illustrates a block diagram of a wireless electronic device 100, according to various embodiments. As illustrated in FIG. 3, a wireless electronic device 100 may include a multi-band antenna system 346, a transceiver 342, and a processor 351. The wireless electronic device 100 may further include a display 354, keypad 352, speaker 356, memory 353, microphone 350, and/or camera 358.

A transmitter portion of the transceiver 342 converts information, which is to be transmitted by the wireless electronic device 100, into electromagnetic signals suitable for radio communications (e.g., to the network 110 illustrated in FIG. 1). A receiver portion of the transceiver 342 demodulates electromagnetic signals, which are received by the wireless electronic device 100 from the network 110 to provide the information contained in the signals in a format understandable to a user of the wireless electronic device 100. The transceiver 342 may include transmit/receive circuitry (TX/RX) that provides separate communication paths for supplying/receiving RF signals to different radiating elements of the multi-band antenna system 346 via their respective RF feeds. Accordingly, when the multi-band antenna system 346 includes two active antenna elements (e.g., the antennas 212, 222), the transceiver 342 may include two transmit/receive circuits 343, 345 connected to different ones of the antenna elements via the respective RF feeds.

The transceiver 342, in operational cooperation with the processor 351, may be configured to communicate according to at least one radio access technology in two or more frequency ranges. The at least one radio access technology may include, but is not limited to, WLAN (e.g., 802.11/WiFi), WiMAX (Worldwide Interoperability for Microwave Access), TransferJet, 3GPP LTE (3rd Generation Partnership Project Long Term Evolution), 4G, Time Division LTE (TD LTE), Universal Mobile Telecommunications System (UMTS), Global Standard for Mobile (GSM) communication, General Packet Radio Service (GPRS), enhanced data rates for GSM evolution (EDGE), DCS, PDC, PCS, Code Division Multiple Access (CDMA), wideband-CDMA, and/or CDMA2000. The radio access technology may operate using such frequency bands as 700-800 Megahertz (MHz), 824-894 MHz, 880-960 MHz, 1710-1880 MHz, 1820-1990 MHz, 1920-2170 MHz, 2300-2400 MHz, and 2500-2700 MHz. Other radio access technologies and/or frequency bands can also be used in embodiments according to the inventive concepts. Various embodiments may use antennas 214 and 224 to provide coverage for non-cellular frequency bands such as Global Positioning System (GPS), WLAN, and/or Bluetooth® frequency bands. As an example, in various embodiments according to the inventive concepts, the local wireless network 170 (illustrated in FIG. 1) is a WLAN compliant network. In various other embodiments according to the inventive concepts, the local wireless network 170 is a Bluetooth® compliant interface.

The wireless electronic device 100 is not limited to any particular combination/arrangement of the keypad 352 and the display 354. As an example, it will be understood that the functions of the keypad 352 and the display 354 can be provided by a touch screen, such as the touch screen of display 230, through which the user can view information, such as computer displayable documents, provide input thereto, and otherwise control the wireless electronic device 100. Additionally or alternatively, the wireless electronic device 100 may include a separate keypad 352 and display 354.

Memory 353 can store computer program instructions that, when executed by the processor circuit 351, carry out the operations described herein and shown in the figures. As an example, the memory 353 can be non-volatile memory, such as EEPROM (flash memory), that retains the stored data while power is removed from the memory 353.

Figure 4:
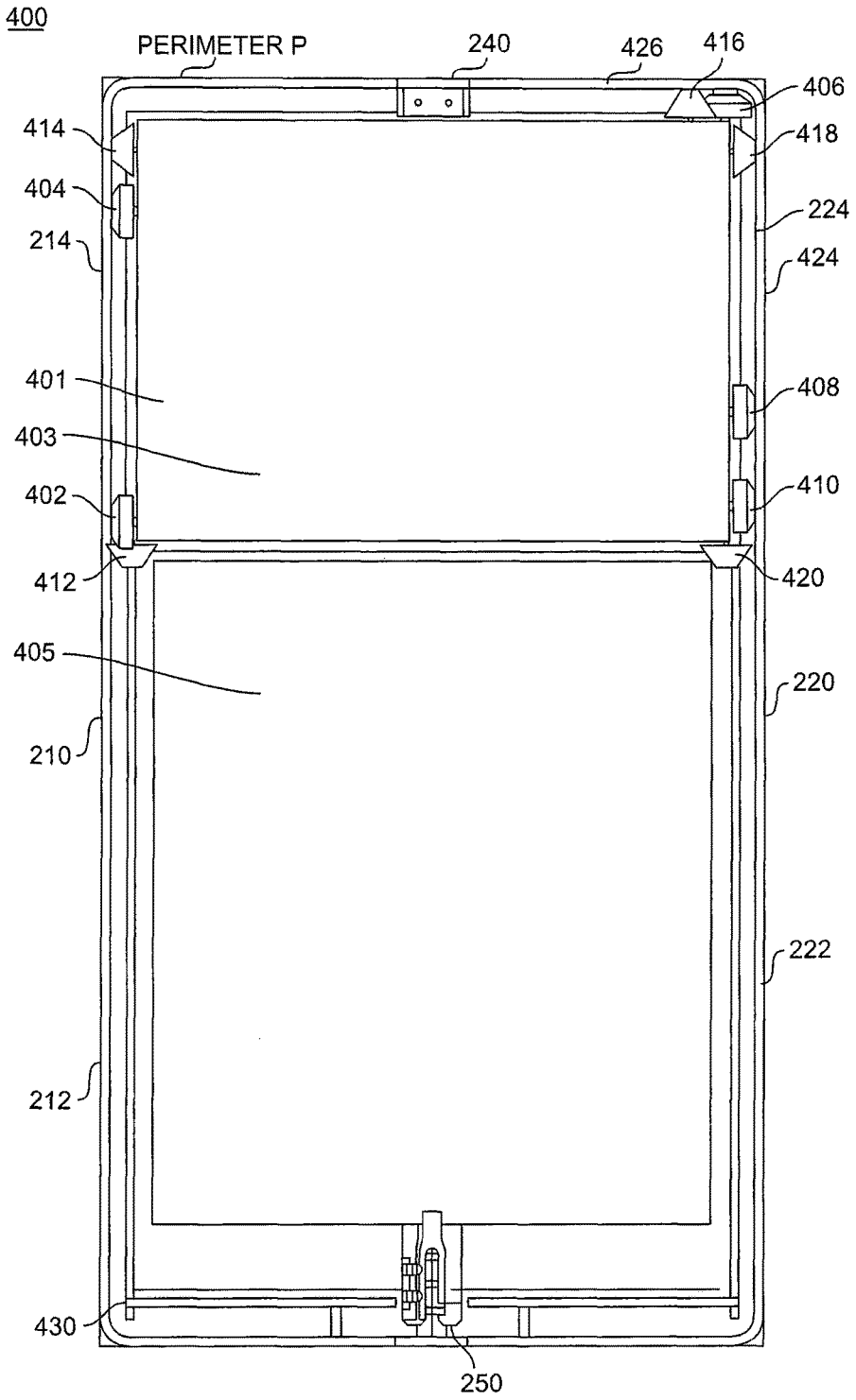
FIG. 4 illustrates a detailed view of a wireless electronic device have metal perimeter portions, according to various embodiments.

FIG. 4 illustrates an internal view 400 of the electronic device 100, according to various embodiments. Device view 400 shows multiple antennas and suggested positions of the antenna connectors (feeds/triangular components) on the ground plane, or PBA. The first metal band 210 includes the first antenna 212 and the second antenna 214. The first antenna 212 may be connected to the ground plane 401 via a ground connection 402. The first antenna 212 may be coupled to feed 412. In some embodiments, first antenna 212 may be transformed from half-loop type to a monopole/parasitic combination by breaking the loop in the middle. The second antenna 214 may be coupled to feed 420 and grounded by ground connection 410. The second antenna 214 may be a global positioning system (GPS) antenna.

The second metal band 220 includes the third antenna 224 and the fourth antenna 222. The third antenna 224 may be a wireless (WiFi), Wireless Local Area Network (WLAN) (e.g., 802.11) and/or Bluetooth® antenna or any other antenna that uses short-range protocols. The third antenna 224 may be a single-band or dual-band WiFi antenna operating at frequency bands of about 2.4 GHz and/or about 5.0 GHz. In some embodiments, antenna 224 may comprise two WiFi/Bluetooth® antennas, WiFi/Bluetooth® antenna 424 and WiFi/Bluetooth® antenna 426. WiFi/Bluetooth® antenna 424 may be coupled to feed 418 and grounded by ground connection 408. WiFi/Bluetooth® antenna 426 may be coupled to feed 416 and grounded by ground connection 406.

In some embodiments, the second antenna 214 may be a diversity cellular antenna that may be combined with a non-cellular application such as GPS. It will be understood, however, that the second antenna 214 may alternatively be a main/primary cellular antenna, and that the first antenna 212 may be a diversity cellular antenna and/or a non-cellular antenna. This may also apply to antennas 222 and 224.

FIG. 4 also shows how the first metal band 210 and second metal band 220 are insulated from each other at user input components 240 and 250. It should be noted that in other embodiments, the first through fourth antennas 212, 214, 224 and 222 may be rearranged at different locations of the outer surface edges TE, BE and SE of perimeter P and/or the metal front outer surface. Also, any of the antennas may include a primary cellular antenna, a diversity cellular antenna, a Global Positioning System (GPS) antenna, and/or a WiFi/Bluetooth antenna. It will be understood that, in some embodiments, more or fewer than the four antennas 212, 214, 224 and 222 may be included in the metal perimeter P of the wireless electronic device 100. Moreover, the metal perimeter P may include a decorrelation component (e.g., a decorrelation antenna) that is physically connected to the ground plane 401 and is configured to electrically divide the ground plane 401 into two portions 403 and 405 to improve the performance of the antennas 212, 214, 222 and 224. The sizes of the antennas and the positions of the feeds and connectors may be adjusted for functional and performance purposes, according to some embodiments.

In some embodiments, the first, second, third and fourth antennas 212, 214, 224 and 222 may be electrically and/or physically coupled to matching circuits, respectively. The matching circuits may each be the same type of matching circuit or may be different types of matching circuits. For example, the matching circuits may provide capacitive feeds for the antennas. In other words, the matching circuit may be electrically, but not physically, coupled to the antenna. In contrast, some matching circuits may provide a direct feed for the antenna. In another example, the matching circuit may provide an inductive feed (which is physically connected to the ground plane 401) for the antenna. It will be understood, however, that the any antenna may alternatively use an inductive feed or a direct feed.

As the first and second antennas 212, 214 may be physically connected to each other along the metal perimeter P by metal (e.g., by a metal insert/filling or by sharing the ground connection), it will be understood that the first and second antennas 212, 214 may each include a metal outer surface that physically contacts the metal outer surface of the other antenna. The first and second antennas 212, 214 may thus collectively define an uninterrupted metal outer surface that is a continuously-metal outer surface in an outer surface edge SE and portions of top and bottom edges TE and SE. In other words, respective metal outer surfaces of the first and fourth antennas 212, 214 may physically connect to provide a combined metal outer surface that only/exclusively includes metal. Accordingly, outer surface side edges SE and portions of the outer surface edges BE and TE that include a combination of the first and second antennas 212, 214 may be free of non-metal (e.g., plastic, glass, ceramic, etc.) discontinuities and may thus provide a more continuous metal look and/or feel to the exterior of the wireless electronic device 100. Likewise for second and third antennas 214 and 224.

Referring to FIG. 4, the outer surface edges E of the wireless electronic device 100 may have input connector components 240 and 250, which may provide space for an input/output component such as a headphone port/jack, a Universal Serial Bus (USB) port, a high definition audio/video port (e.g., High-Definition Multimedia Interface (HDMI) or Mobile High-Definition Link (MHL)), a Subscriber ID Module (SIM) card, and/or a speaker (e.g., the speaker 356) connection, among others.

According to some embodiments, if there are buttons or other user inputs along the metal bands 210 and 220 to incorporate openings or non-metal materials/components, it will be understood that each of the openings/materials may be completely surrounded by metal of the metal outer surface edges to provide a more continuous metal look and/or feel to the exterior of the wireless electronic device 100. Moreover, whereas the first and second antennas 212, 214 may have a shared ground connection, the third antenna 224 is separated from the first and second antennas 212, 214 along the metal perimeter P by the input connector component 240 and thus does not share a ground connection with either of the first and second antennas 210, 214.

Accordingly, the metal bands 210 and 220 separated by input connection components 240 and 250, which, according to some embodiments, may have planar outer surfaces of plastic, glass, and/or ceramic provide a metal perimeter that may improve the continuity of the wireless electronic device 100's metal look and feel along the perimeter.

Figure 5:
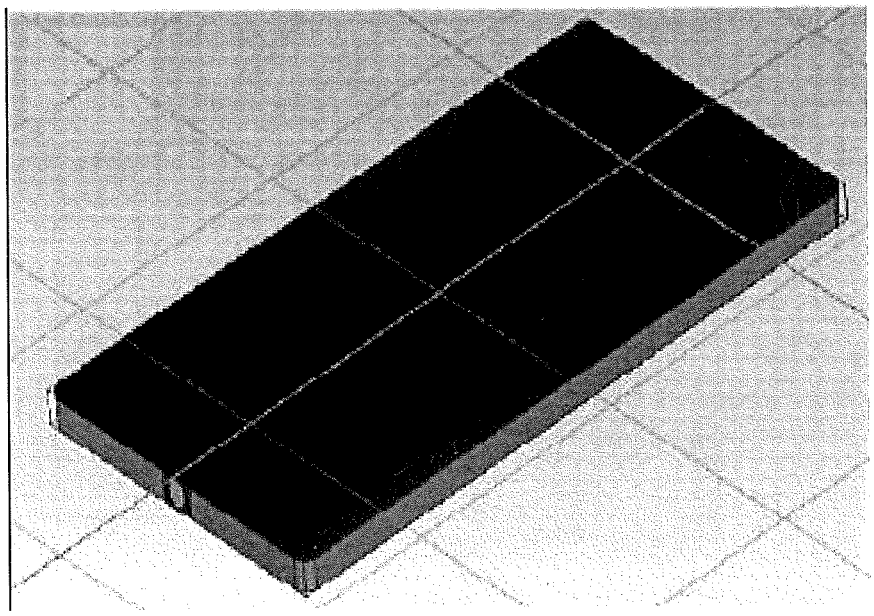
FIG. 5 illustrates a different view of the metal bands of a wireless electronic device, according to various embodiments.

FIG. 5 illustrates another angled side view 500 of a metal perimeter formed by metal bands and coplanar insulating input components, according to various embodiments of the present inventive concepts. As shown in FIG. 5, the metal perimeter portions, or antenna portions, may include curved corners between a side edge SE and a top edge TE or bottom edge BE on the perimeter P. Also, the input connector portion at the small (bottom) edge is shown to completely separate the portions.

Figure 6:
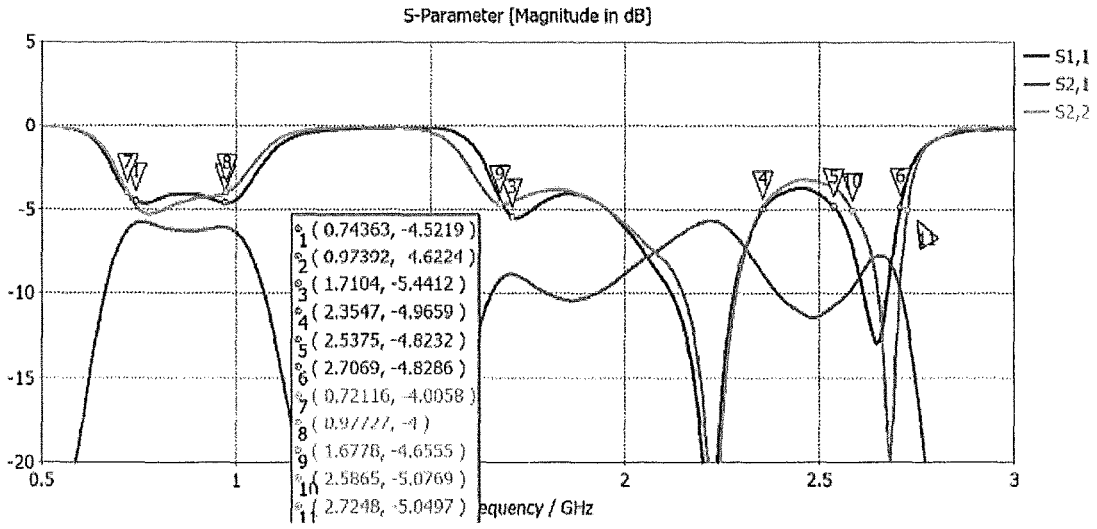
FIGS. 6-8 illustrate S-parameters of antennas of a wireless electronic device, according to various embodiments.

FIG. 6 illustrates results from a simulation model 600, according to various embodiments. Model with results 600 is based on a wireless electronic device having dimensions 141×75×6 mm. Antenna clearance may include 10 mm at the bottom, 2.25 mm on the front side, 3 mm on the back side and 3.5 mm at the top. Antenna −4 db impedance bandwidth is about 256 MHz (from 721 MHz to 977 MHz) in lower cellular bands, about 678 MHz in higher bands (1677 to 2355 MHz) and there is an additional resonance converting Band 7 (2500 MHz-5690 MHz). This is in the model's lossless structure to operate cellular bands from 699 to 960 MHz and from 1710 to 2690 MHz.

Figure 7:
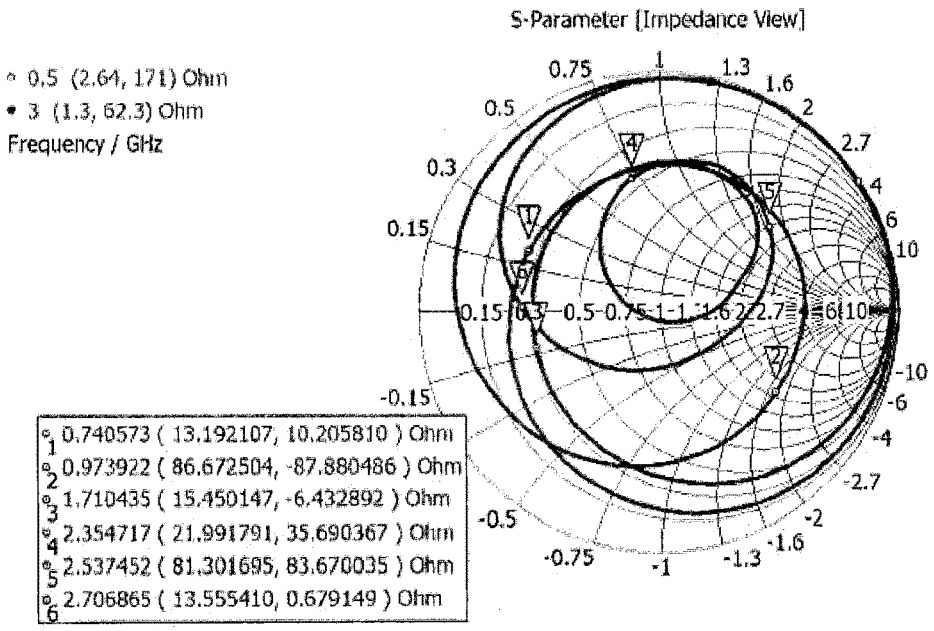
Figure 8:
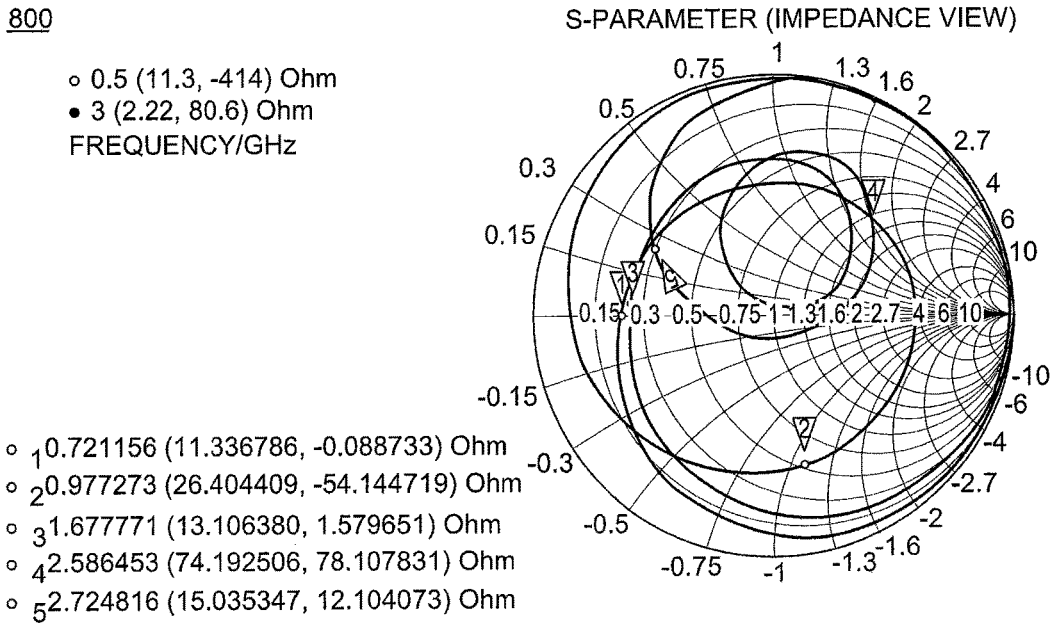
Figure 9:
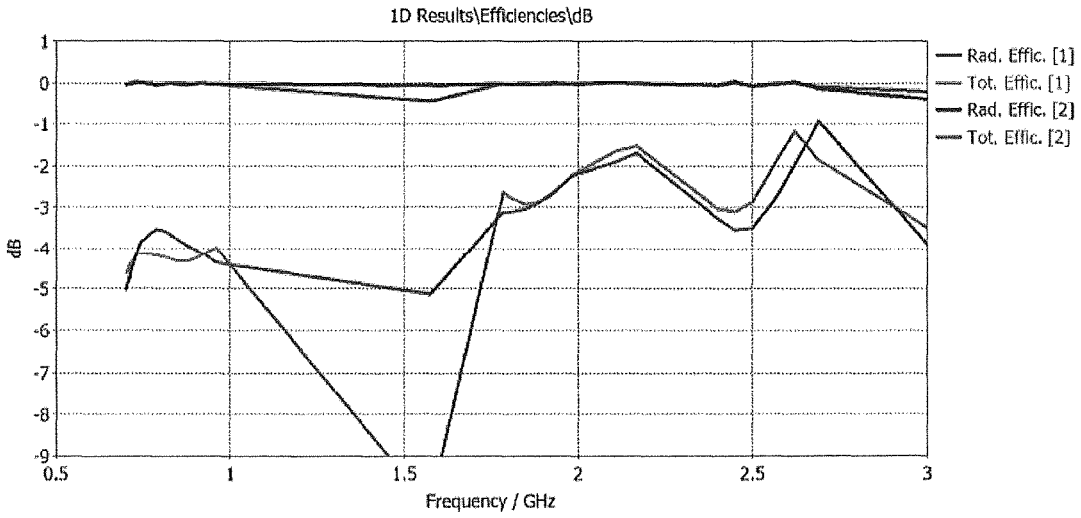
FIG. 9 illustrates a chart showing efficiencies of the antennas, according to various embodiments.
Figure 10:
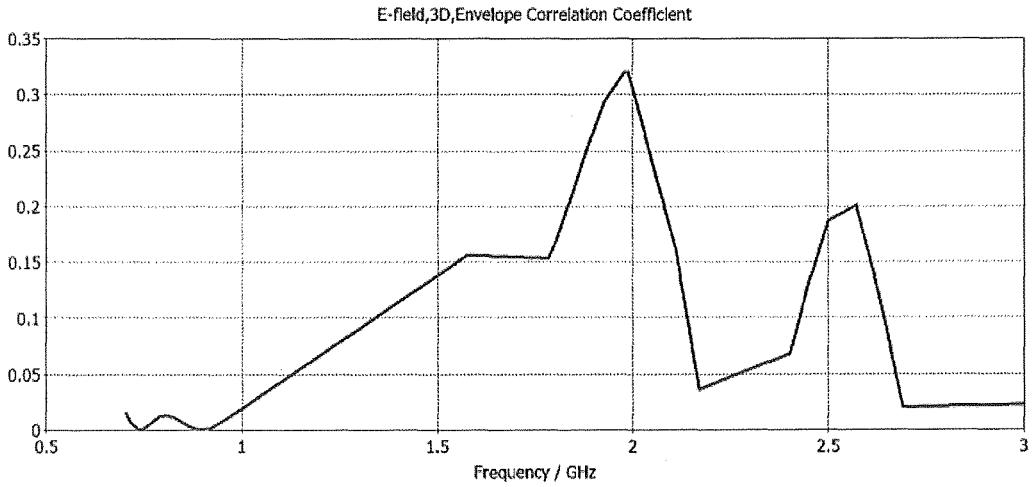
FIG. 10 illustrates a chart showing envelope correlation coefficients (ECCs) between antennas, according to various embodiments.

Various other performance charts are provided. FIG. 7 illustrates a Smith Chart Free Space 700 for feed 412 of device 400, according to some embodiments. FIG. 8 illustrates a Smith Chart Free Space 800 for feed 420 of device 400, according to some embodiments. FIG. 9 illustrates a chart 900 showing total and radiated efficiencies of the cellular antennas 212 and 222, according to some embodiments. FIG. 10 illustrates a chart 1000 showing envelope correlation coefficients (ECCs) between cellular antennas 212 and 222 below 0.35 in free space (very low below 1 GHz), according to some embodiments.

Figure 11:
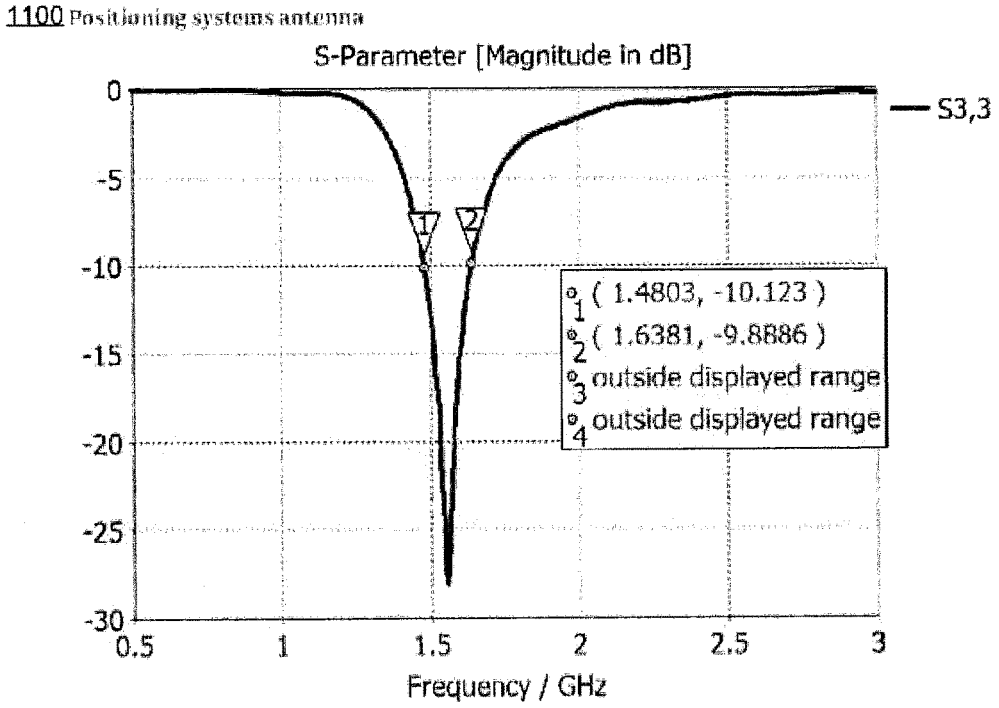
FIG. 11 illustrates a chart showing positioning antenna tuning, according to various embodiments.
Figure 12:
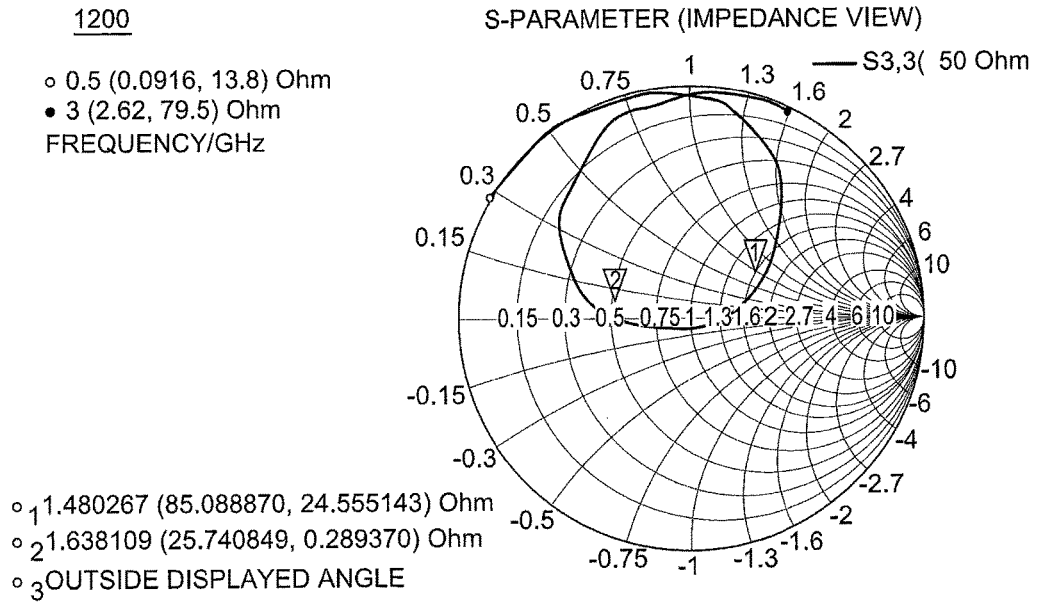
FIG. 12 illustrates a chart showing positioning antenna matching, according to various embodiments.
Figure 13:
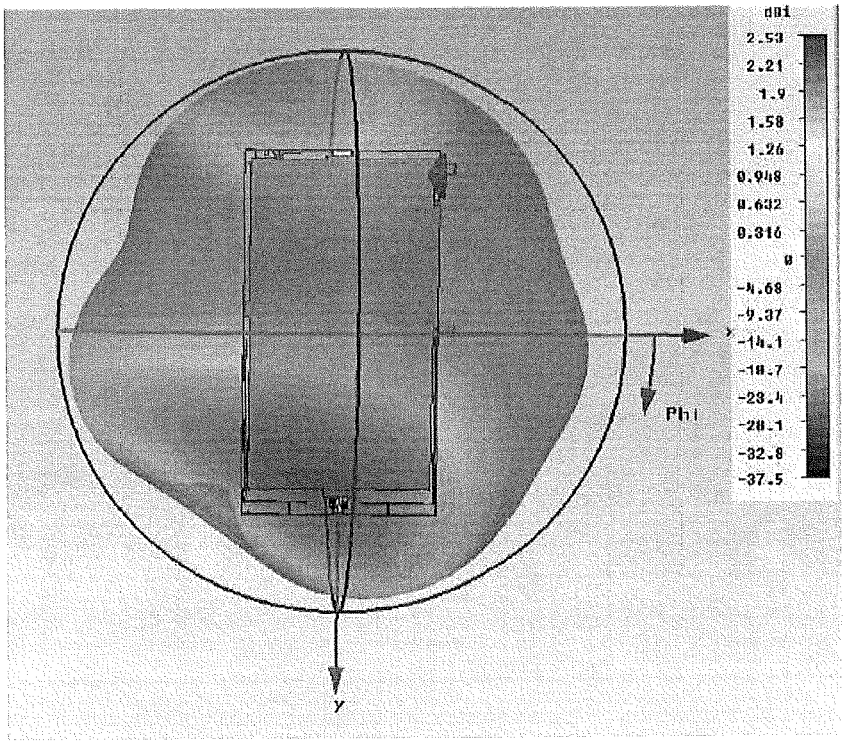
FIG. 13 illustrates a positioning antenna 3D pattern, according to various embodiments.
Figure 14:
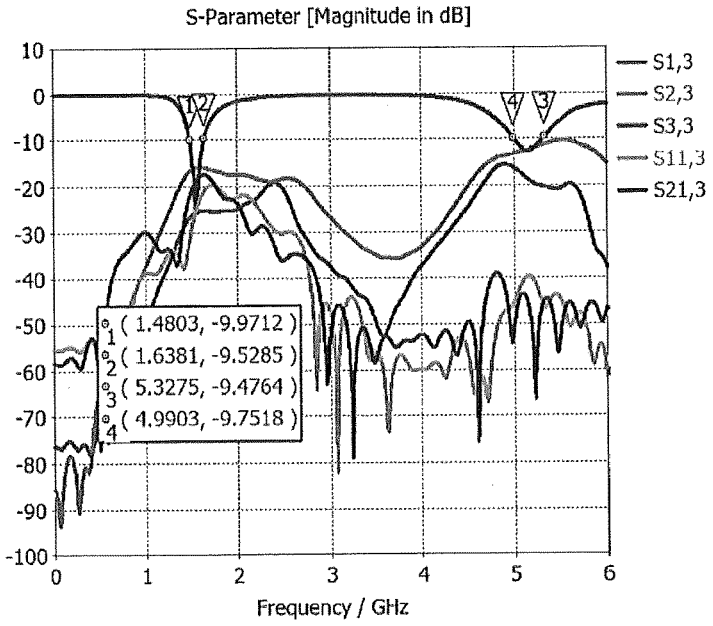
FIG. 14 illustrates a chart showing positioning antenna isolation from other antennas, according to various embodiments.

FIG. 11 illustrates a chart 1100 showing positioning antenna 214 tuning, according to some embodiments. FIG. 12 illustrates a chart 1200 showing positioning antenna 214 matching, according to some embodiments. FIG. 13 illustrates a positioning antenna 214 3D pattern 1300 with respect to front side of device 400, according to some embodiments. FIG. 14 illustrates a chart 1400 showing positioning antenna 214 isolation from other antennas, according to some embodiments.

Figure 15:
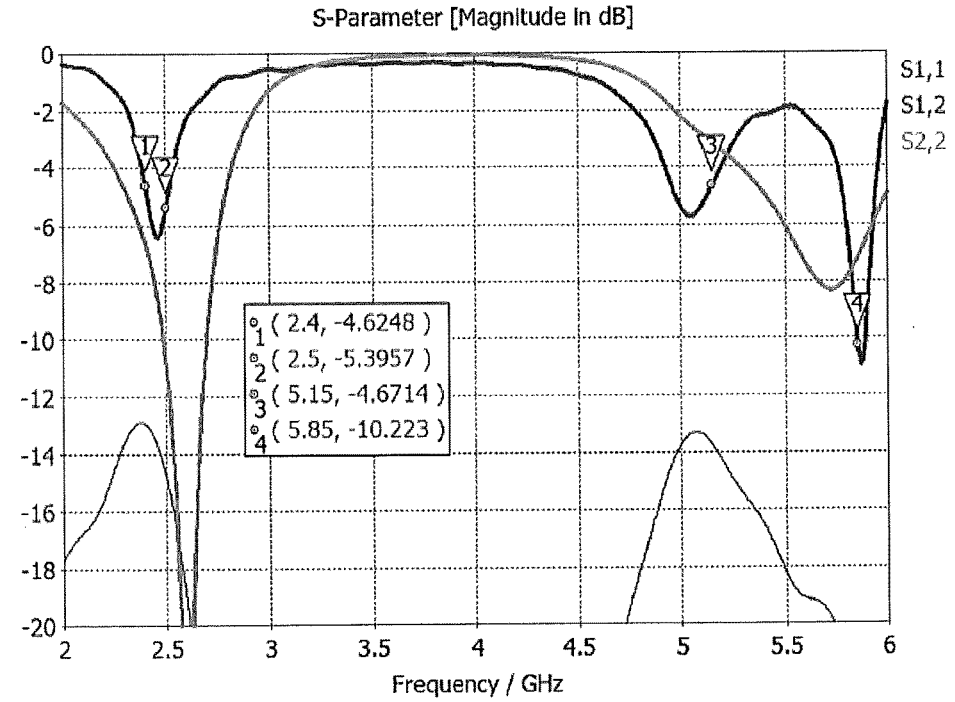
FIG. 15 illustrates a chart showing antenna tuning and isolation, according to various embodiments.
Figure 16:
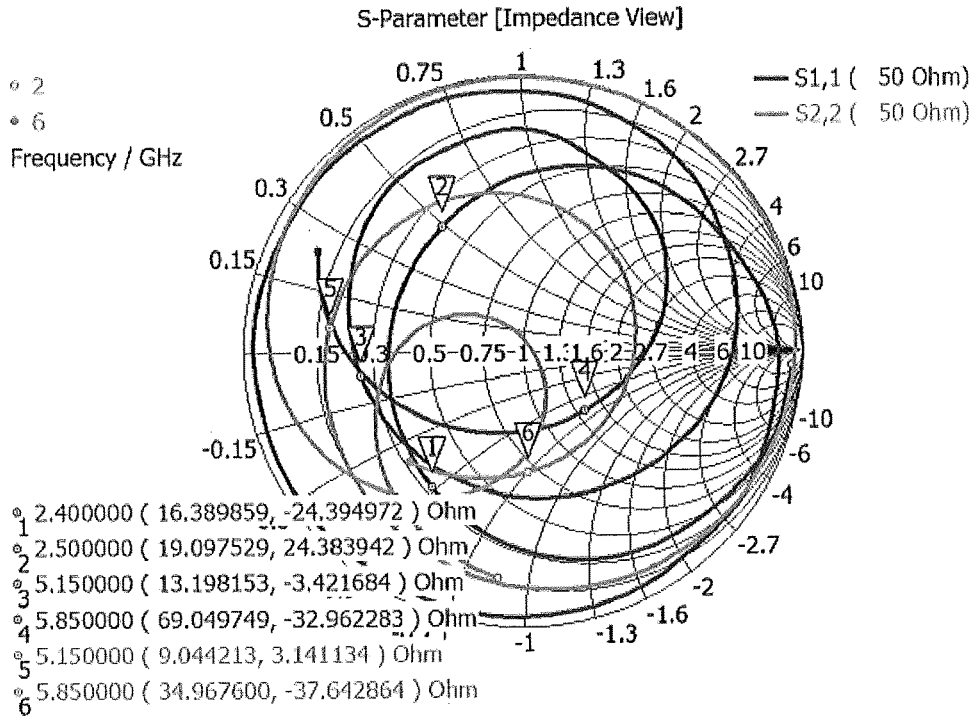
FIG. 16 illustrates a chart showing antenna matching, according to various embodiments.
Figure 17:
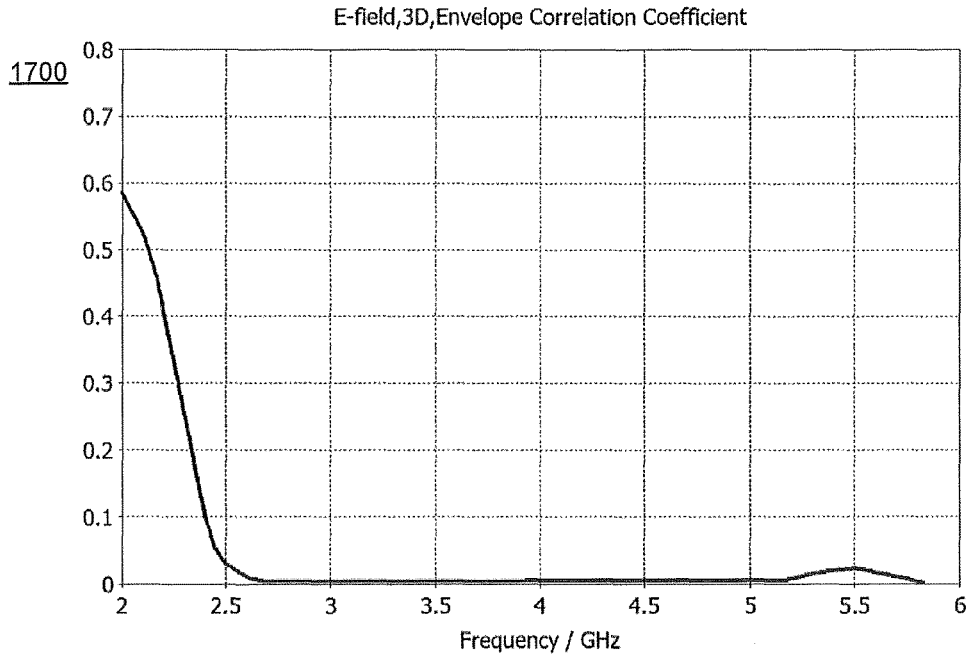
FIG. 17 illustrates a chart showing ECC between antennas, according to various embodiments.
Figure 18:
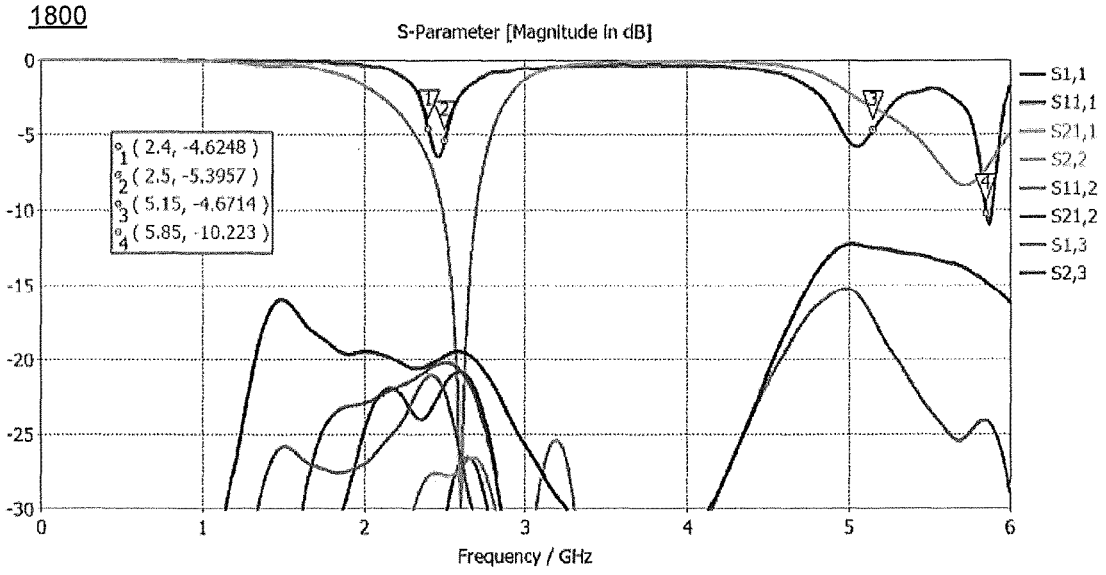
FIG. 18 illustrates a chart showing isolation from other antennas, according to various embodiments.

FIG. 15 illustrates a chart 1500 showing antennas tuning and isolation between them, according to some embodiments. FIG. 16 illustrates a chart 1600 showing WiFi antennas 424 and 426 matching, according to some embodiments. FIG. 17 illustrates a chart 1700 showing ECC between WiFi antennas 424 and 426 is below 0.1 in free space, according to some embodiments. FIG. 18 illustrates a chart 1800 showing isolation to other antennas, according to some embodiments.

Various embodiments described herein provide a more continuous metal look and/or feel to the exterior of the wireless electronic device 100, while providing good performance characteristics.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

The invention claimed is:

1. A wireless electronic device, comprising:

a ground plane;

a first metal band extending along a perimeter around and spaced apart from the ground plane, the first metal band comprising a first radiating antenna element;

a second metal band extending along the perimeter opposite the first metal band, the second metal band comprising a second radiating antenna element;

a first input connector port on the perimeter galvanically insulating a first end of the first metal band from a first end of the second metal band, the first input connector port comprising a first insulator that galvanically insulates the first end of the first metal band from the first end of the second metal band, and the first input connector port being configured to receive a first mating connector from an exterior of the wireless electronic device and to provide an electrical connection to the first mating connector; and a second input connector port on the perimeter galvanically insulating a second end of the first metal band and a second end of the second metal band, the second input connector port comprising a second insulator that galvanically insulates the second end of the first metal band from the second end of the second metal band, and the second input connector port being configured to receive a second mating connector from the exterior of the wireless electronic device and to provide an electrical connection to the second mating connector.

2. The wireless electronic device of claim 1, wherein the first and second metal bands each comprise continuous metal surfaces, and wherein the continuous metal surfaces of the first and second metal bands and the first and second input connector ports collectively define a continuous outer surface of the wireless electronic device along a full length of the perimeter.

3. The wireless electronic device of claim 1, wherein at least one of the first and second metal bands forms a u-shape and wherein the first and second input connector ports comprise outer surfaces that are substantially coplanar with outer surfaces of the first and second ends of the first and second bands.

4. The wireless electronic device of claim 1, wherein the first metal band further comprises a third radiating antenna element and the second metal band further comprises a fourth radiating antenna element.

5. The wireless electronic device of claim 4, wherein the first and third radiating antenna elements are physically connected on the perimeter to each other by the first metal band and the second and fourth radiating antenna elements are physically connected to each other on the perimeter by the second metal band.

6. The wireless electronic device of claim 4, wherein the first and fourth radiating antenna elements comprise first and second cellular radiating antenna elements, respectively.

7. The wireless electronic device of claim 6, wherein the first and second cellular radiating antenna elements comprise first and second half-loop radiating antenna elements, respectively.

8. The wireless electronic device of claim 6, further comprising a multi-band transceiver circuit coupled to at least one of the first and second cellular radiating antenna elements and configured to provide communications for the wireless electronic device via a plurality of frequency bands.

9. The wireless electronic device of claim 6, wherein the third radiating antenna element comprises a positioning radiating antenna element.

10. The wireless electronic device of claim 9, further comprising:

a first ground connection between the first metal band and the ground plane at an end of the first cellular radiating antenna element, separately defining the first cellular radiating antenna element from the positioning radiating antenna element.

11. The wireless electronic device of claim 6, wherein the second radiating antenna element comprises a non-cellular radiating antenna element.

12. The wireless electronic device of claim 11, wherein the second radiating antenna element comprises a WiFi radiating antenna element.

13. The wireless electronic device of claim 11, further comprising:

a second ground connection between the second metal band and the ground plane at an end of the second cellular radiating antenna element, separately defining the second cellular radiating antenna element from the non-cellular radiating antenna element.

14. The wireless electronic device of claim 1, wherein the first and second input connector ports are respectively located in a respective middle of each opposing smaller side edge of the perimeter.

15. The wireless electronic device of claim 1, wherein the first and second input connector ports comprise an audio jack and a power/data input component.

16. A wireless electronic device comprising:

a ground plane;

first and second metal antenna bands forming a metal perimeter around the ground plane, the first and second metal antenna bands being symmetrical with respect to each other, the first metal antenna band comprising a first radiating antenna element, the second metal antenna band comprising a second radiating antenna element; and first and second discontinuities in the metal perimeter separating the first and second metal antenna bands, wherein the first discontinuity separating the first and second metal antenna bands comprises a first input connector port that is configured to receive a first mating connector from an exterior of the wireless electronic device and to provide an electrical connection to the first mating connector, and wherein the second discontinuity separating the first and second metal antenna bands comprises a second input connector port that is configured to receive a second mating connector from the exterior of the wireless electronic device and to provide an electrical connection to the second mating connector.

17. The wireless electronic device of claim 16, further comprising third and fourth radiating antenna elements, wherein the first and third radiating antenna elements share the first metal antenna band and the second and fourth radiating antenna elements share the second metal antenna band.

18. The wireless electronic device of claim 17, wherein at least two of the first, second, third and fourth radiating antenna elements are coupled to a multi-band transceiver circuit and configured to provide communications for the wireless electronic device via a plurality of frequency bands using LTE-Advanced carrier aggregation.

19. The wireless electronic device of claim 18, wherein at least two of the first, second, third and fourth radiating antenna elements are coupled to a multi-band transceiver circuit and configured to provide communications for the wireless electronic device via a plurality of frequency bands using LTE-Advanced carrier aggregation.

20. The wireless electronic device of claim 17, wherein the first and second metal antenna bands each comprise continuous metal surfaces, and wherein the continuous metal surfaces of the first and second metal antenna bands and the first and second discontinuities collectively define a continuous outer surface of the wireless electronic device along a full length of the metal perimeter.

21. A wireless electronic device comprising:

a ground plane;

a metal perimeter around the ground plane comprising at least two radiating elements of respective antennas; and first and second discontinuities in the metal perimeter at two opposing edges of the wireless electronic device, wherein the first discontinuity comprises a first insulator that is configured to galvanically insulate portions of the metal perimeter and a first opening that is configured to receive a first connector from an exterior of the wireless electronic device and to provide an electrical connection to the first connector, and wherein the second discontinuity comprises a second insulator that is configured to galvanically insulate portions of the metal perimeter and a second opening that is configured to receive a second connector from the exterior of the wireless electronic device and to provide an electrical connection to the second connector.

22. The wireless electronic device of claim 21, wherein the antennas of the metal perimeter comprise:

first and second cellular antennas;

a global positioning antenna; and first and second non-cellular antennas, and wherein the first and second discontinuities comprise input components that comprise the first and second openings, respectively.

* * * * *